US007408568B2

(12) United States Patent
Kobayashi

(10) Patent No.: US 7,408,568 B2
(45) Date of Patent: Aug. 5, 2008

(54) IMAGE FORMING APPARATUS AND NETWORK SYSTEM PROVIDED WITH THE SAME

(75) Inventor: Akihiro Kobayashi, Osaka (JP)

(73) Assignee: Kyocera Mita Corporation (JP)

( * ) Notice: Subject to any disclaimer, the term of this patent is extended or adjusted under 35 U.S.C. 154(b) by 151 days.

(21) Appl. No.: 11/443,397

(22) Filed: May 30, 2006

(65) Prior Publication Data

US 2006/0268093 A1 Nov. 30, 2006

(30) Foreign Application Priority Data

May 31, 2005 (JP) ..... 2005-159043

(51) Int. Cl.
*B41J 2/435* (2006.01)

(52) U.S. Cl. ..... 347/262; 347/264

(58) Field of Classification Search ..... 347/262, 347/264, 116, 229, 234, 248; 399/391; 271/259, 271/3.06, 3.16, 3.18, 226, 242–243
See application file for complete search history.

(56) References Cited

U.S. PATENT DOCUMENTS 5,797,080 A * 8/1998 Okamoto ..... 399/391
6,651,980 B2 * 11/2003 Isemura et al. ..... 271/259

FOREIGN PATENT DOCUMENTS

JP 2002-116590 4/2002

* cited by examiner

*Primary Examiner*—Hai C Pham
(74) *Attorney, Agent, or Firm*—Gerald E. Hespo; Anthony J. Casella

(57) ABSTRACT

A controller stops a registration roller to temporarily hold a recording sheet and restarts the registration roller at a timing of transferring an image formed on an intermediate transferring belt to a predetermined position of the recording sheet. Then, an adjustment time calculator compares a time measured by a time counter with a predetermined reference time and calculates the difference between the measured time and the reference time as the adjustment time. The controller controls the driving of the sheet feeding mechanism based on the calculated adjustment time so that the waiting time of a next recording sheet becomes closer to the predetermined reference time.

7 Claims, 8 Drawing Sheets

IMAGE FORMING APPARATUS AND NETWORK SYSTEM PROVIDED WITH THE SAME

BACKGROUND OF THE INVENTION

1. Field of the Invention

The present invention relates to an image forming apparatus which forms a color image or a monochromatic image on a recording sheet, and a network system provided with the image forming apparatus. Particularly, it relates to a technology to reduce a delay in sheet feeding.

2. Description of the Related Art

In color image forming apparatuses such as a printer apparatus, a copying machine, and a facsimile apparatus, there is known a color tandem type where a plurality of developing devices contain different color toner particles, e.g., cyan, magenta, yellow, black, respectively, and individually develop latent images formed on a photoconductive drum, toner images of respective colors are transferred successively to a transferring belt, and the toner images are transferred from the transferring belt to a recording sheet, and fixed by a fixing device.

In the case of requiring high speed image forming, particularly, an image forming apparatus of the color tandem type having a transferring belt is employed much more. In a color tandem type image forming apparatus, a latent image forming process is started prior to a sheet feeding operation, and the sheet feeding operation is started during the time when the transferring belt receives toner images. To regulate the timing of conveying a recording sheet to an image transfer position where a toner image is transferred from the transferring belt to a recording sheet, a pair of registration rollers temporarily holds the recording sheet for a predetermined time (waiting time), and then conveys the recording sheet. The waiting time is set at a time not to cause jamming of a recording sheet at the registration roller.

Further, the timing of starting the sheet feeding operation is fixedly set when designing the image forming apparatus. Therefore, the waiting time of the recording sheet at the pair of registration rollers is ideally constant. However, in actual image forming apparatuses, a delay in sheet feeding occurs due to a protrusion of a leading end of a recording sheet from a sheet cassette, a physical slippage occurred between a recording sheet and rollers for conveying the recording sheet, or a defect in a pickup operation performed by a pickup roller.

As a technology of suppressing such delay in sheet feeding and smoothly supplying a recording sheet to an image forming portion, for example, Japanese Unexamined Patent Publication No. 2002-116590 discloses a technology to compensate for a delay in sheet feeding for each recording sheet by controlling the timing of starting rotation of a sheet feeding roller.

However, the technology disclosed in this prior art document has the problem that a control device and related parts are subject to a great operation load to compensate for delay in sheet feeding every time before the image transfer to each recording sheet is completed.

SUMMARY OF THE INVENTION

It is an object of the present invention to provide a novel technology which is from the problems described above.

It is another object of the present invention to provide a novel image forming apparatus and network printer system which can efficiently suppress delay in sheet feeding due to wearing of a roller and such.

According to an aspect of the present invention, an image forming apparatus comprising: a sheet cassette for storing a number of recording sheets; a sheet feeding mechanism for picking up and conveying a recording sheet from the sheet cassette; an image bearing member rotated at a constant speed; an image forming unit for forming an image on the image bearing member; a registration roller for receiving a recording sheet conveyed by the sheet feeding mechanism, and holding the recording sheet temporarily, and restarting the conveyance of the recording sheet at a timing of transferring the image formed on the image bearing member by the image forming unit to a predetermined position of the recording sheet; a time counter for measuring a waiting time from the reception of the recording sheet by the registration roller to the start of the conveyance of the recording sheet by the registration roller; a calculator for calculating an adjustment time based on a deviation of a waiting time measured by the time counter against a predetermined reference time; and a controller for controlling the driving of the sheet feeding mechanism based on the calculated adjustment time so that the waiting time of a next recording sheet becomes closer to the predetermined reference time.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Figure 1:
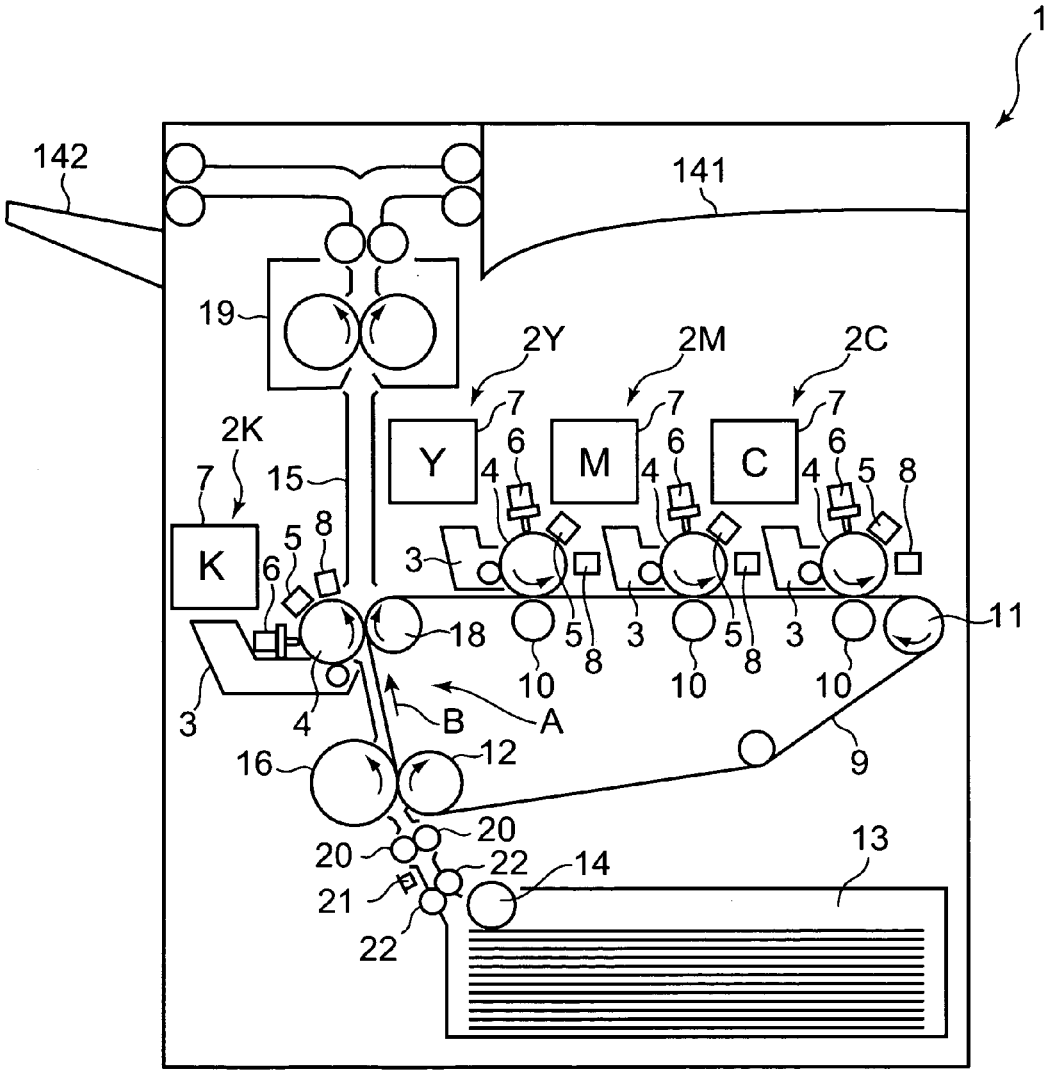
FIG. 1 is a diagram showing a schematic construction of an image forming apparatus or printer according to an embodiment of the invention.

Hereinafter, an image forming apparatus according to an embodiment of the present invention is described with reference to drawings. FIG. 1 is a diagram showing a schematic construction of an image forming apparatus or printer according to an embodiment of the present invention. As shown in FIG. 1, a printer 1, an example of image forming apparatuses, comprises a main body provided with image forming units 2Y, 2M, 2C and 2K for colors of yellow (Y), magenta (M), cyan (C) and black (K), respectively.

Each of the image forming units 2Y, 2M, 2C includes a developing device 3, a photoconductive drum 4, a charging device 5, an exposure device 6 having an LED print head and the like, a toner supplying device 7, a cleaning device 8, and a transferring roller 10. An intermediate transferring belt (image bearing member) 9, which is endless, runs through respective lower portions of the image forming units 2Y, 2M, 2C. The intermediate transferring belt 9 is pressed to the photoconductive drums 4 of the respective image forming units 2Y, 2M, 2C by the transferring rollers 10. As shown by an arrow A, further, the intermediate transferring belt 9 partially runs through a sheet conveyance passage 15 extending from a sheet cassette 13 to a sheet discharge portions 141, 142. The intermediate transferring belt 9 is rotated by driving rollers 11, 12 in a direction following a rotational direction of the photoconductive drums 4, namely, in a sheet conveying direction in the sheet conveyance passage 15 (a direction indicated by an arrow B) . The driving rollers 11, 12 are rotationally driven by an unillustrated motor.

The image forming unit 2K is provided at a position opposing (facing) the intermediate transferring belt 9 in the sheet conveyance passage 15, and includes a developing device 3, a photoconductive drum 4, a charging device 5, an exposure device 6 having an LED print head and the like, a toner supplying device 7, a cleaning device 8 and a black color image transferring roller 18. At the position where the image forming unit 2K is provided, the intermediate transferring belt 9 is pressed by the black color image transferring roller 18 onto the photoconductive drum 4 of the image forming unit 2K.

The driving roller 12 is provided at a position of the sheet conveyance passage 15 facing the sheet conveyance passage 15. At a position opposing the driving roller 12 in the sheet conveyance passage 15, a second transferring roller 16 is provided so as to oppose the driving roller 12 through the intermediate transferring belt 9. The secondary transferring roller 16 can be mechanically made contact with and spaced apart from the driving roller 12. Further, at a further downstream from the secondary transferring roller 16 in the sheet conveyance passage 15, a fixing device 19 including a pair of fixing rollers are provided.

When a color printing is performed, in the image forming units 2Y, 2M, 2C, 2K, toner images of the respective colors, yellow, magenta, cyan and black are formed on the respective photoconductive drums 4. Then, the toner images of the respective colors formed on the photoconductive drums 4 are successively transferred at an appropriate timing onto the intermediate transferring belt 9 rotated endlessly and superimposed in the order of black, yellow, magenta and cyan. A color image formed by successively superimposing toner images of respective colors onto the intermediate transferring belt 9 is moved to the position of the driving roller 12 by the endless rotation.

Meanwhile, it is preferable that toner images of respective colors are formed on the photoconductive drums 4 in the order of black, yellow, magenta, cyan as described above from the viewpoint of forming a color image more quickly. However, the forming order is not limited to this. For example, an image may be formed in the order of yellow, magenta, cyan, black. In this case, an influence (e.g., influence of a filter effect) of an order of superimposing toner images (an order of forming toner images) can be considerably suppressed. The filter effect means that a toner image developed in advance acts as a color filter and affects the color of a toner image formed later (color separation).

A sheet feeding mechanism picks up and conveys a recording sheet from a sheet cassette 13. A nip portion of a pair of registration rollers 20 receives the recording sheet conveyed by the sheet feeding mechanism, and holds an end edge of the recording sheet. At this time, a registration sensor 21 spaced a predetermined distance from the registration rollers detects passing of the recording sheet. The pair of registration rollers 20 restarts conveyance of the recording sheet to the secondary transferring roller 16 at a timing of transferring a color image formed on the intermediate transferring belt 9 to the recording sheet. Consequently, the color image on the intermediate transferring belt 9 is transferred to the recording sheet conveyed from the sheet cassette 13 through the recording sheet conveyance passage 15 at a nip portion between the secondary transferring roller 16 and the intermediate transferring belt 9 at the position of the driving roller 12. In the embodiment, the sheet feeding mechanism is constituted by the pickup roller 14 and a pair of sheet feeding rollers 22. The pickup roller 14 is adapted for picking up a recording sheet, and the sheet feeding rollers 22 are adapted for conveying a recording sheet to the registration roller 20.

As described above, at the image transfer position (indirect image transfer position) of the secondary transferring roller 16, the color image formed by superimposing toner images of the respective colors formed by the image forming units 2Y, 2M, 2C, 2K is transferred to the recording sheet at one time in an indirect transferring manner.

The recording sheet on which the color image is transferred is conveyed through the sheet conveyance passage 15. The recording sheet passes through the image transfer position of the image forming unit 2K (the photoconductive drum 4 and the black color transferring roller 18), and further conveyed to the fixing device 19 provided on downstream. After the fixing of the color image by the fixing device 19, the recording sheet is discharged to the sheet discharge portion 141 or the sheet discharge portion 142. In the case of discharging a recording sheet in the face-down state that the image bearing surface of the recording sheet faces downward, the recording sheet is discharged to the recording sheet discharge portion 141. In the case of discharging a recording sheet in the face-up state that the image bearing surface of the recording sheet faces up, the recording sheet is discharged to the recording sheet discharge portion 142.

In the case where a recording sheet is printed with a color image formed on the intermediate transferring belt 9 in the order of black, yellow, magenta, cyan to the image transferring position, the recording sheet is conveyed from the sheet cassette 13 to the image transferring position of the secondary transferring roller 16 (the nip portion between the secondary transferring roller 16 and the intermediate transferring belt 9) in synchronization with the arrival of the color image one the intermediate transferring belt 9 by the endless rotation of the intermediate transferring belt 9.

Furthermore, after the color image on the secondary transferring roller 16 is transferred, the image transfer (toner image forming operation) by the image forming unit 2K is not performed with respect to the recording sheet conveyed to the position of the image forming unit 2K (the position of the photoconductive drum 4 of the image forming unit 2K and the black color transferring roller 18). The recording sheet merely passes through the position of the image forming unit 2K toward downstream. When the recording sheet passes through the position of the image forming unit 2K, the photoconductive drum 4 and the black color transferring roller 18 are rotationally driven with the endless rotation of the intermediate transferring belt 9 to convey the recording sheet.

Furthermore, when performing a monochromatic printing, after a black toner image is formed on the photoconductive drum 4, the toner image is transferred onto the intermediate transferring belt 9 rotated endlessly. The monochromatic image formed by transferring the black toner image to the intermediate transferring belt 9 is moved to the position of the driving roller 12 by the endless rotation. Then, the monochromatic image is transferred to the recording sheet conveyed from the sheet feeding cassette 13 through the sheet conveyance passage 15 at the nipping portion between the secondary transferring roller 16 and the driving rollers 12.

Thereafter, the recording sheet on which the black color image is transferred is conveyed to the fixing device 19, and the black image is fixed on the recording sheet by the fixing device 19. Consequently, the monochromatic image formed by only a black color component is fixedly retained on the recording sheet. Then, the recording sheet on which the monochromatic image is formed, as in the color printing described above, is discharged to the recording sheet discharge portion 141 or to the recording sheet discharge portion 142 according to the face-down discharge or the face-up discharge. In the case where the monochromatic printing is performed, the intermediate transferring belt 9 rotates endlessly in the state where the image forming units 2Y, 2M 2C do not transfer any toner images to the intermediate transferring belt 9 nor execute any image formation of the image forming units 2Y, 2M, 2C.

Figure 2:
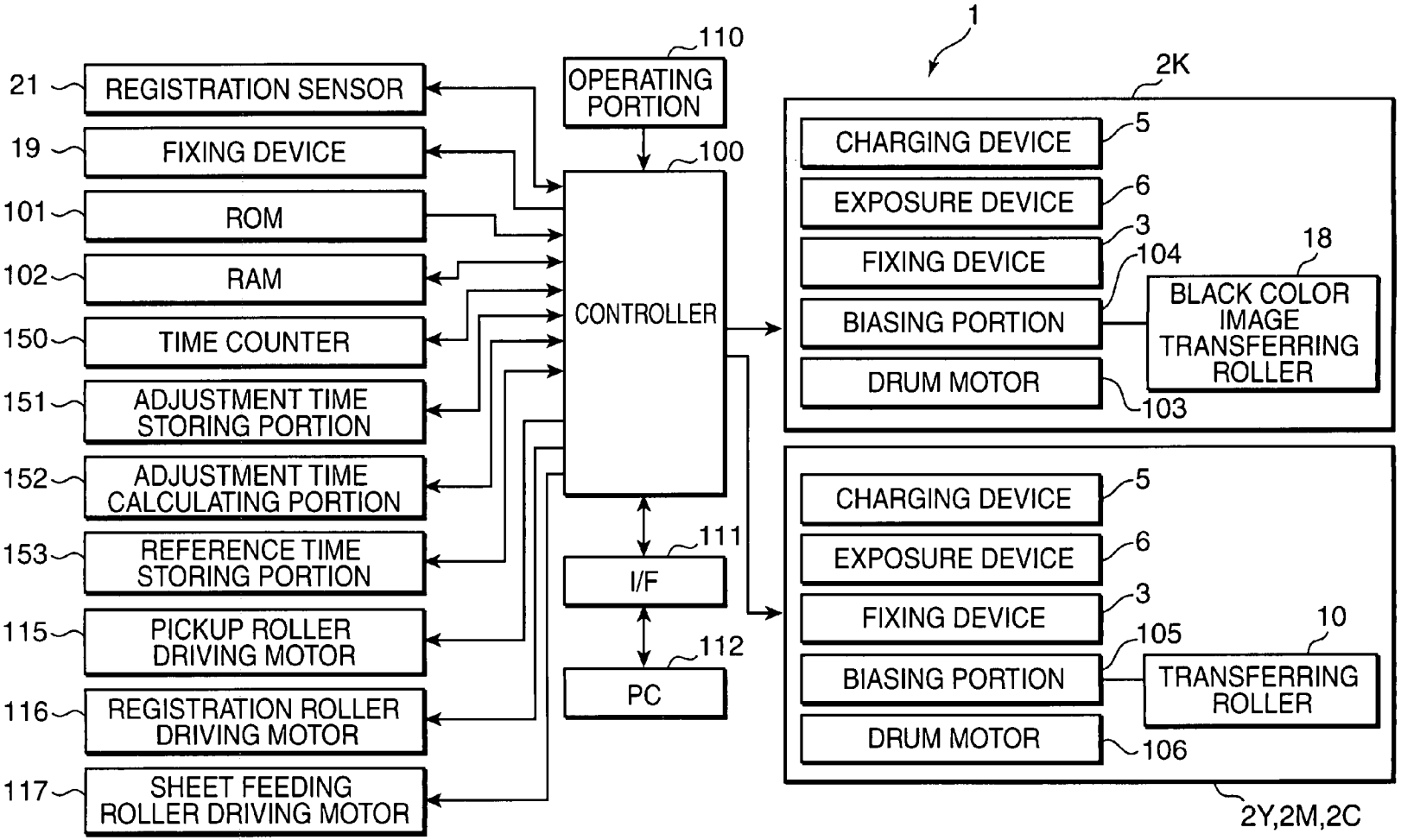
FIG. 2 is a functional block diagram showing a construction of a network printer system including the printer according to the embodiment of the invention.

FIG. 2 is a functional block diagram showing a construction of a network printer system including the printer 1. The printer 1 comprises a controller 100 adapted for controlling overall operations of the printer 1. A time counter 150 (a time counter), an adjustment time storing portion 151 (a memory), and an adjustment time calculator (a calculator) 152 are connected to the controller 100. The time counter 150 is, for example, a free-run time counter which performs counting in interruption pulses used for conveyance control of a recording sheet. The time counter 150 is adapted for measuring a time (waiting time) from the reception of the recording sheet by the pair of registration rollers 20 to the restart of the conveyance of the recording sheet by the pair of registration rollers 20. The adjustment time storing portion 151 is adapted for storing a current adjustment time calculated by the adjustment time calculator 152. A reference time storing portion 153 is adapted for storing a predetermined reference time which should be compared to the waiting time.

A ROM (Read Only Memory) 101 which stores a program for controlling the overall operations of the printer 1 and a RAM (Random Access Memory) 102 for temporarily storing an image data are connected to the controller 100. The RAM 102 functions also as a working area. Further, image forming units 2Y, 2M, 2C, 2K for color images are connected to the controller 100.

The controller 100 controls the developing device 3, the charging device 5, the exposure device 6 and a drum motor 103 or a drum motor 106 included in each of the image forming units 2Y, 2M, 2C, 2K. The drum motor 103 and the drum motor 106 serve as driving sources of the photoconductive drums 4. The controller 100 controls a biasing portion 104 provided in the image forming unit 2K. The biasing portion 104 is adapted for applying a transfer bias to the black color image transferring roller 18. The transfer bias is applied to the black color image transferring roller 18 for the indirect transfer of a toner image formed on the photoconductive drum 4 of the image forming unit 2K to the intermediate transferring belt 9. Further, the controller 100 controls biasing portions 105 provided in the image forming units 2Y, 2M, 2C. The biasing portions 105 are adapted for applying a transfer bias to the transferring rollers 10. The transfer bias is applied to the image transferring roller 10 for the indirect transfer of a toner image formed on the respective photoconductive drum 4 of the image forming units 2Y, 2M, 2C to the intermediate transferring belt 9. The image forming units for the colors of yellow, magenta and cyan are shown as a single image forming unit in FIG. 2. However, the respective image forming units for the respective colors are connected to and controlled by the controller 100.

Further, the controller 100 controls a black color image transferring roller driving motor, a transferring roller driving motor, a belt driving motor, a conveyance motor and a secondary transferring roller driving motor which are not illustrated. The black color image transferring roller driving motor is adapted for driving the black color image transferring roller 18. The transferring roller driving motor serves as a driving source of each transferring roller 10. The belt driving motor serves as a driving source of the driving rollers 11, 12 for endlessly rotating the intermediate transferring belt 9. The conveyance motor is adapted for rotationally driving each of unillustrated conveyance roller provided in the recording sheet conveyance passage 15 for conveying a recording sheet from the sheet cassette 13 to the sheet discharge portions 141, 142. The secondary transferring roller driving motor serves as a driving source of the secondary transferring roller 16. Furthermore, the controller 100 controls a pickup roller driving motor 115, a registration roller driving motor 116 and a sheet feeding roller driving motor 117. The pickup roller driving motor 115 serves as a driving source of the pickup roller 14. The registration roller driving motor 116 serves as a driving source of the registration roller 20. The sheet feeding roller driving motor 117 serves as a driving source of the sheet feeding roller 22.

Further, the controller 100 is communicably connected to a PC (personal computer) 112, which is an external terminal, via a predetermined network through an interface (I/F) 111. The printer 1 performs image forming based on an image data inputted by the PC 112.

Further, the fixing device 19 is connected to the controller 100. The controller 100 controls a driving motor which rotationally drives the pair of fixing rollers of the fixing device 19 and a heater provided in a heat roller interiorly provided in one of the pair of the fixing rollers. Furthermore, the registration sensor 21 is connected to the controller 100. The registration sensor 21 detects an arrival of a leading edge or a posterior edge of a recording sheet, and transmits a detection signal to the controller 100.

Further, an operating portion 110 is connected to the controller 100. The operating portion 110 includes a display panel for allowing input of a printing instruction or displaying a various types of messages. The controller 100 receives an instruction for printing a monochromatic image (only a black color image) or a color image selectively inputted by a user through the operating portion 110, and controls the transferring operation of an image in each of the image forming units 2Y, 2M, 2C based on the received printing instruction information.

For example, when an instruction for printing a monochromatic image is inputted to the operating portion 110, the controller 100 controls the transferring operation so that the transfer of an image to the intermediate transferring belt 9 in an indirect transfer direction is made only by the image forming unit 2K. Further, when an instruction for printing a color image is inputted to the operating portion 110, the controller 100 controls the transferring operation so that the transfer of an image to the intermediate transferring belt 9 in an indirect transferring direction is made by each of the image forming units 2Y, 2M, 2C with the image forming unit 2K. Furthermore, it goes without saying that the parts other than the image forming units 2Y, 2M, 2C, 2K such as the secondary transferring roller 16 and driving rollers 12 are controlled based on the instruction information inputted to the operating portion 110.

It should be noted that the construction of the printer 1 described above is an example. For instance, the drum motor 106 or the transferring biasing portion 105 is included in each of the image forming units 2Y, 2M, 2C, 2K. However, it may be so constructed that the image forming units use one common drum motor or transferring biasing portion. Further, the pickup roller driving motor 115, the sheet feeding roller driving motor 117 and the registration roller driving motor 116 are provided respectively for the pickup roller 14, the sheet feeding roller 22 and the registration roller 20 as driving sources. However, the construction may be desirably changed so that the pickup roller 14, the sheet feeding roller 22 and the registration roller 20 are provided with a driving force from other driving sources to be driven or the rollers own one common driving source.

Figure 3:
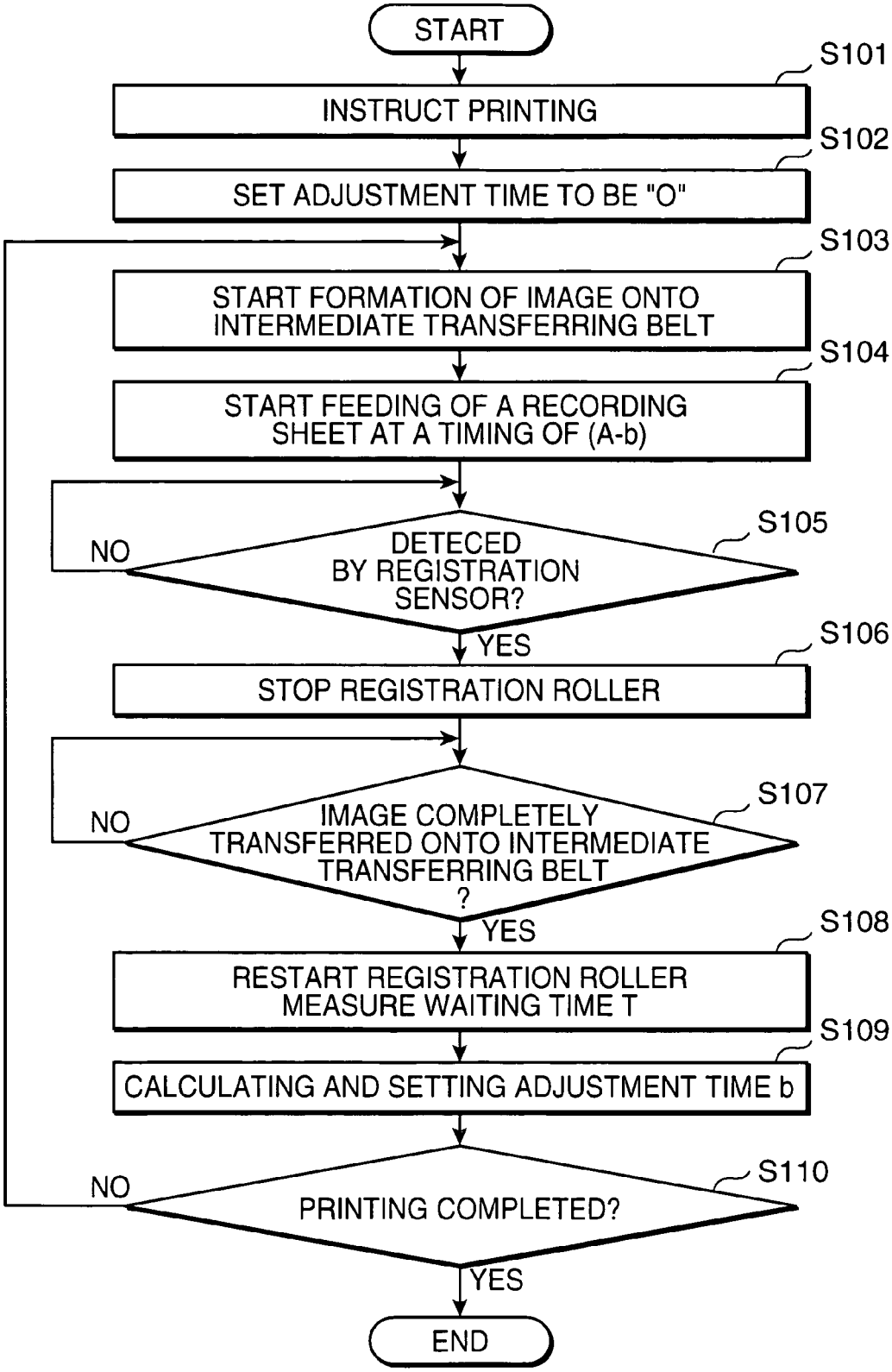
FIG. 3 is a flow chart showing a procedure of adjusting a sheet feed timing in the printer according to the embodiment of the invention.

FIG. 3 is a flow chart showing a procedure for adjusting a sheet feed timing. At first, a user operates the PC 112 to instruct printing of a desired image data (Step S101). The controller 100 sets initial value of "0" (zero) as an adjustment time "b" to the adjustment time storing portion 151. In this embodiment, the adjustment time storing portion 151 may be a volatile memory or an involatile memory. After each of the image forming units 2Y, 2M, 2C, 2K starts formation of a latent image and transfer of the image onto the intermediate transferring belt 9 (Step S103), the pickup roller 14 picks up a recording sheet from the sheet cassette 13, and the sheet feeding roller 22 starts feeding of the recording sheet. (Step S104) In this case, the timing of starting the sheet feeding is set based on a time (A-b) after starting the formation of the image onto the intermediate transferring belt 9 in the Step S103. "A" is a time which is initially set.

Subsequently, when the registration sensor 21 detects passing of the recording sheet ("YES" in step 105), the controller 100 stops the pair of registration rollers 20 to hold the recording sheet temporarily at the position of the registration roller 20 (Step S106). The time counter 150 starts counting from the timing when the recording sheet is stopped. After the image is completely transferred onto the intermediate transferring belt 9 ("YES" in Step S107), the controller 100 restarts the registration roller 20, and the time counter 150 measures a time in which the recording sheet is stopped at the registration roller 20, namely, a waiting time T (Step S108).

The adjustment time calculator 152 compares the waiting time T measured by the time counter 150 with a predetermined reference time X stored in the reference time storing portion 153, calculates a deviation (X-T) as an adjustment time "b" and then sets the adjustment time to the adjustment time storing portion 151 (Step S109) In the case where the printing is performed for only one recording sheet ("YES" in Step S110), the procedure ends. However, in the case where the printing is performed for two sheets or more, the procedure goes back to Step S103. Then, in the Step S104, the pickup roller 14 and the sheet feeding roller 22 start conveying of another recording sheet at the timing according to a time (A-b).

Herein, throughout this embodiment and the other embodiments, the pickup roller 14 and the sheet feeding roller 22 do not need to start feeding of a recording sheet at a timing which completely matches with the timing according to a time (A-b), but may start the sheet feeding at a timing close to the timing according to a time (A-b). In the case where a delay in sheet feeding of a recording sheet is caused by slippage occurred between a recording sheet and rollers for conveying the recording sheet, a deviation in the waiting time from the reference time is almost constant. Therefore, a delay in sheet feeding can be suppressed effectively by advancing the sheet feed timing by an adjustment time calculated at the preceding image transferring operation.

Figure 4:
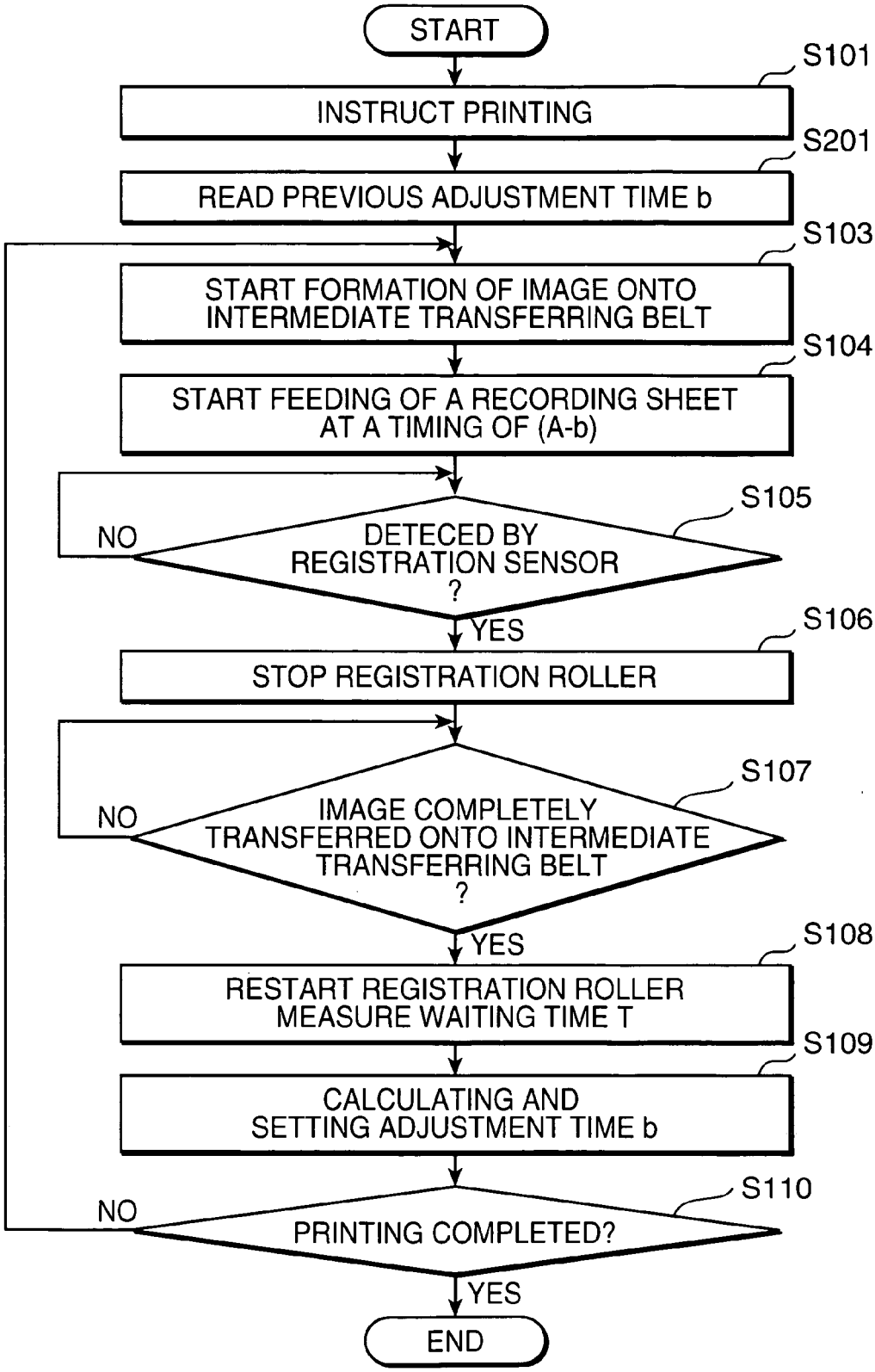
FIG. 4 is a flow chart showing another procedure of adjusting a sheet feed timing in the printer according to the embodiment of the invention.

FIG. 4 is a flow chart showing another procedure of adjusting the sheet feed timing. This procedure (hereinafter, referred to as first procedure) is different from the above-described procedure (hereinafter, referred to as second procedure) only in that the operation in Step S102 of the first procedure is replaced by Step S201 in the second procedure. The operations in the other steps are identical to one another, and description of them will be accordingly omitted.

In the first procedure, the initial value of the adjustment time "b" is set at "0" (zero) in Step S102. However, in the second procedure, the controller 100 reads out the adjustment time calculated in the last image transferring operation from the adjustment time storing portion 151 including an involatile memory. Then, in Step S104, the pickup roller 14 and the sheet feeding roller 22 start the picking and conveyance of a new recording sheet at a timing according to a time (A-b). That is to say, in this procedure, delay in sheet feeding can be efficiently suppressed at the time of image transferring operation for the first recording sheet.

Figure 5:
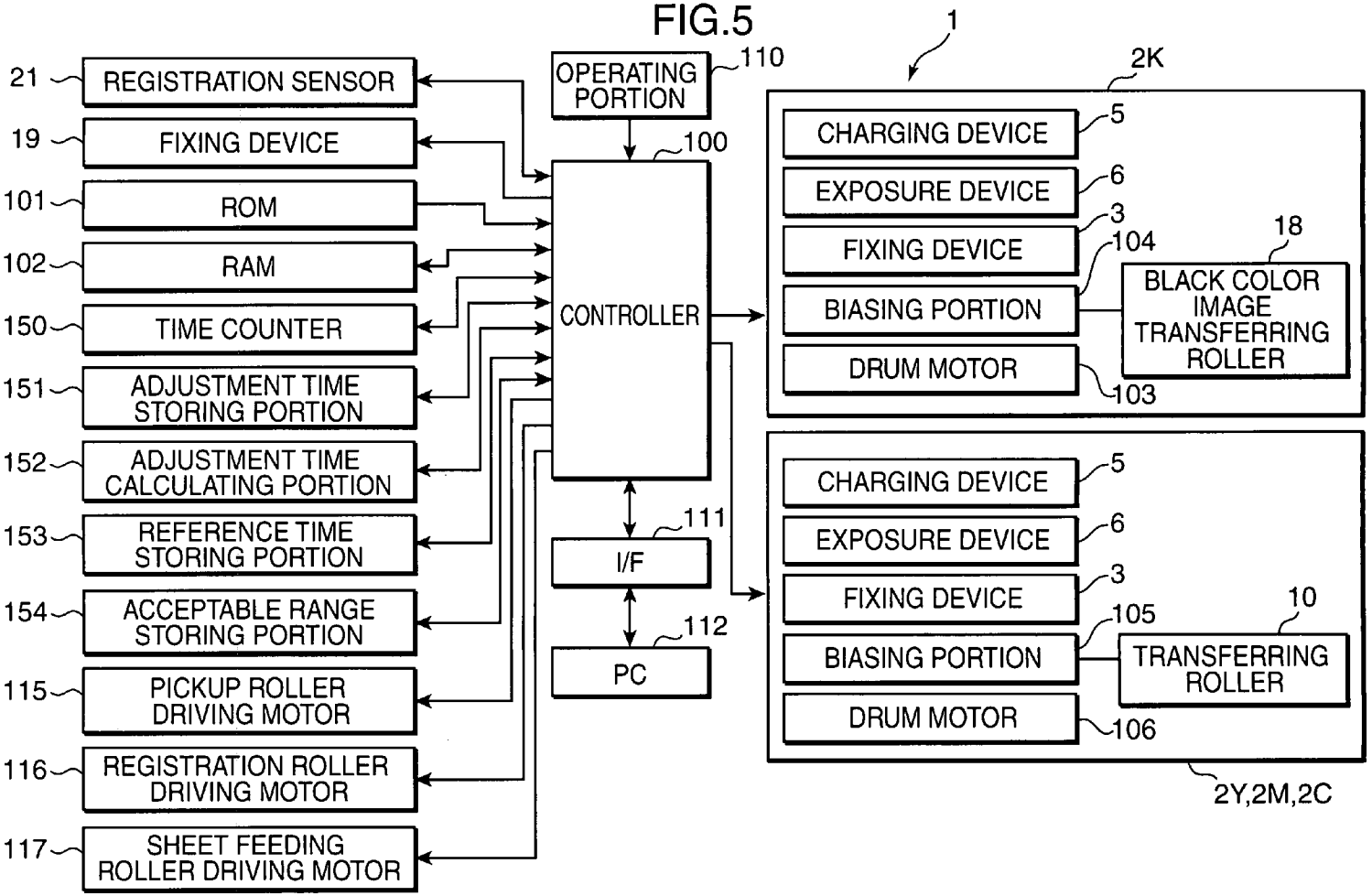
FIG. 5 is a functional block diagram showing a construction of a network printer system including a printer according to another embodiment of the invention.
Figure 6:
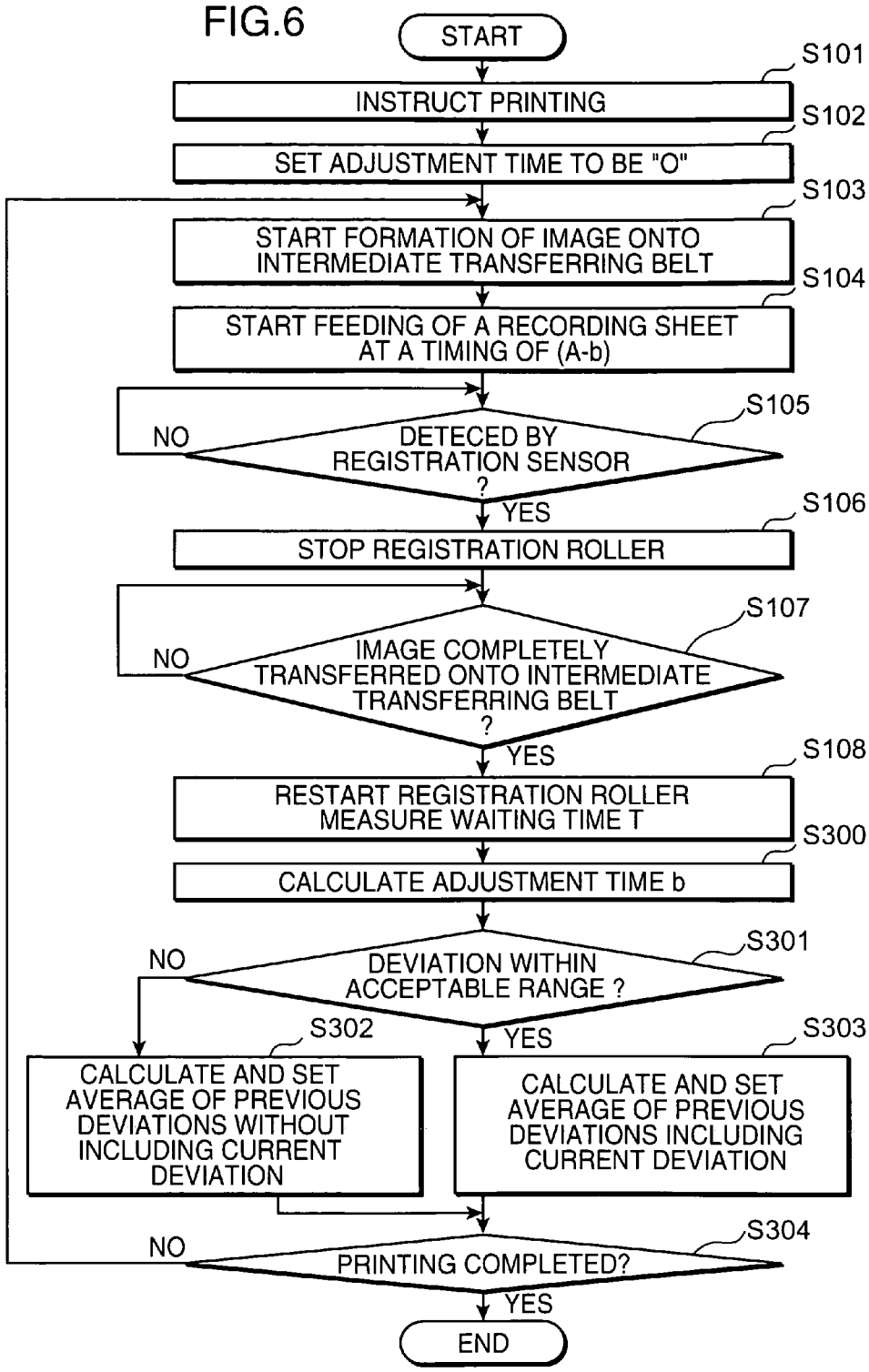
FIG. 6 is a flow chart showing a procedure of adjusting a sheet feed timing in the printer according to the another embodiment of the invention.

FIG. 5 is a functional block diagram showing a schematic construction of a network printer system including a printer according to another embodiment of the invention. FIG. 6 is a flow chart showing a procedure of adjusting the sheet feed timing in the printer shown in FIG. 5. As compared to the embodiment described in FIG. 2, this embodiment is further provided with an acceptable range storing portion 154. Further, the procedure (hereinafter, referred to as third procedure) shown in FIG. 6 is different from the first procedure in that the operations in Steps S109 and S110 in the first procedure are replaced with those in Steps S300 through S304. The operations in the other steps are identical to those in the first procedure, and description of them is thus omitted.

In Step S300 of the third procedure, an adjustment time calculator 152 compares a waiting time T measured by a time counter 150 with a reference time X, and calculates a deviation (X-T) as an adjustment time "b" (Step S300). The adjustment time calculator 152 communicates with the acceptable range storing portion 154, and determines whether the deviation is within an acceptable range or not(Step S301). If the adjustment time calculator 152 determines that the deviation is not within the acceptable range, the adjustment time calculator 152 calculates an average of the previous deviations without including the current deviation, and sets the average of the previous deviations to the adjustment time storing portion 151 as an adjustment time (Step S302). On the contrary, if the adjustment time calculator 152 determines in Step S301 that the deviation is within the acceptable range, the adjustment time calculator 152 calculates an average of the previous deviations including the current deviation, and sets the average of the deviations to the adjustment time storing portion 151 as an adjustment time (Step S303). Then, the operations in the steps described above are repeated until the instructed printing is completed.

As described above, according to this embodiment, even if an exceptional waiting time deviation due to some unexpected causes, such deviation can be eliminated effectively. Consequently, a sheet feeding delay can be suppressed more assuredly.

Figure 7:
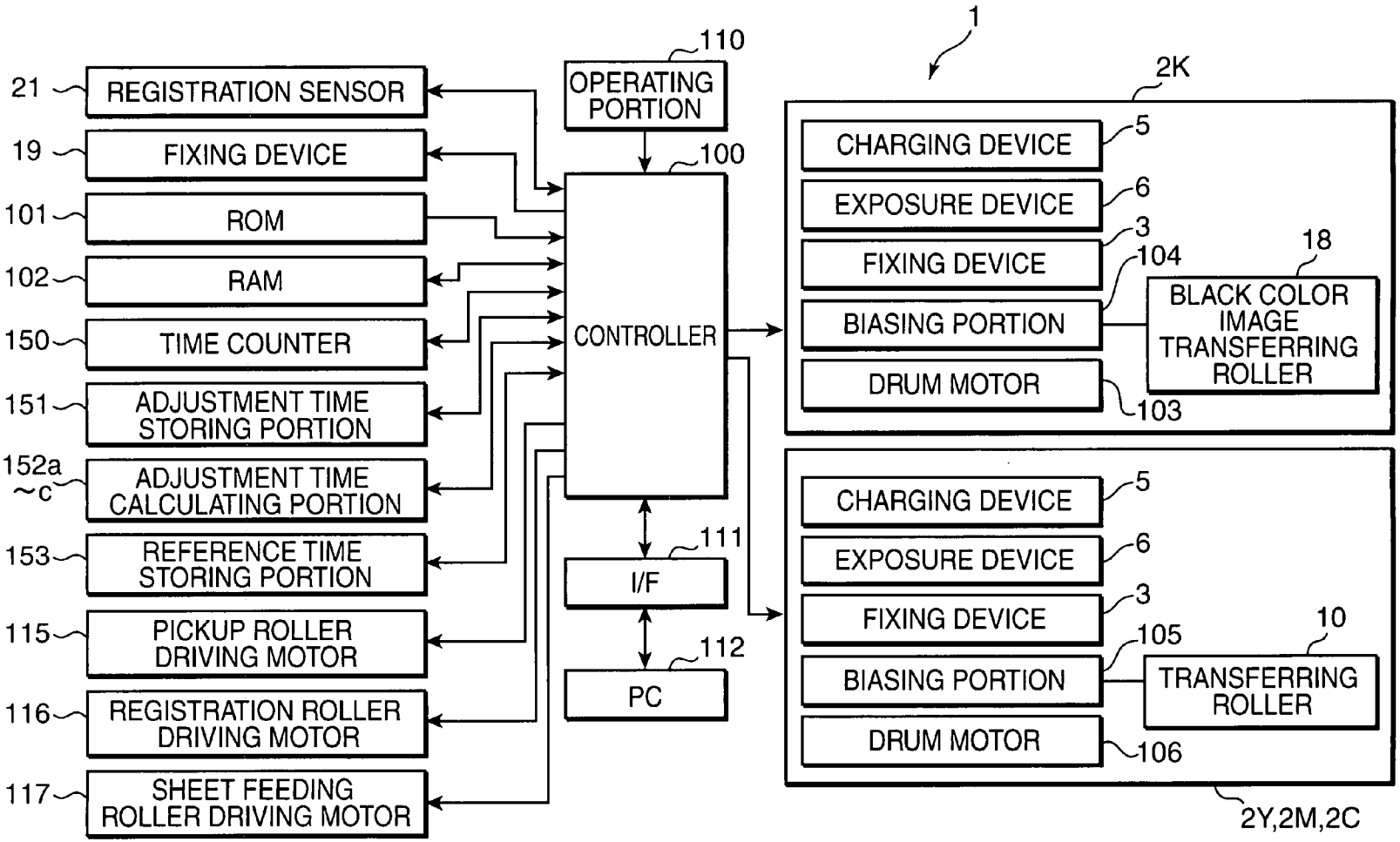
FIG. 7 is a functional block diagram showing a construction of a network printer system including a printer according to still another embodiment of the invention.
Figure 8:
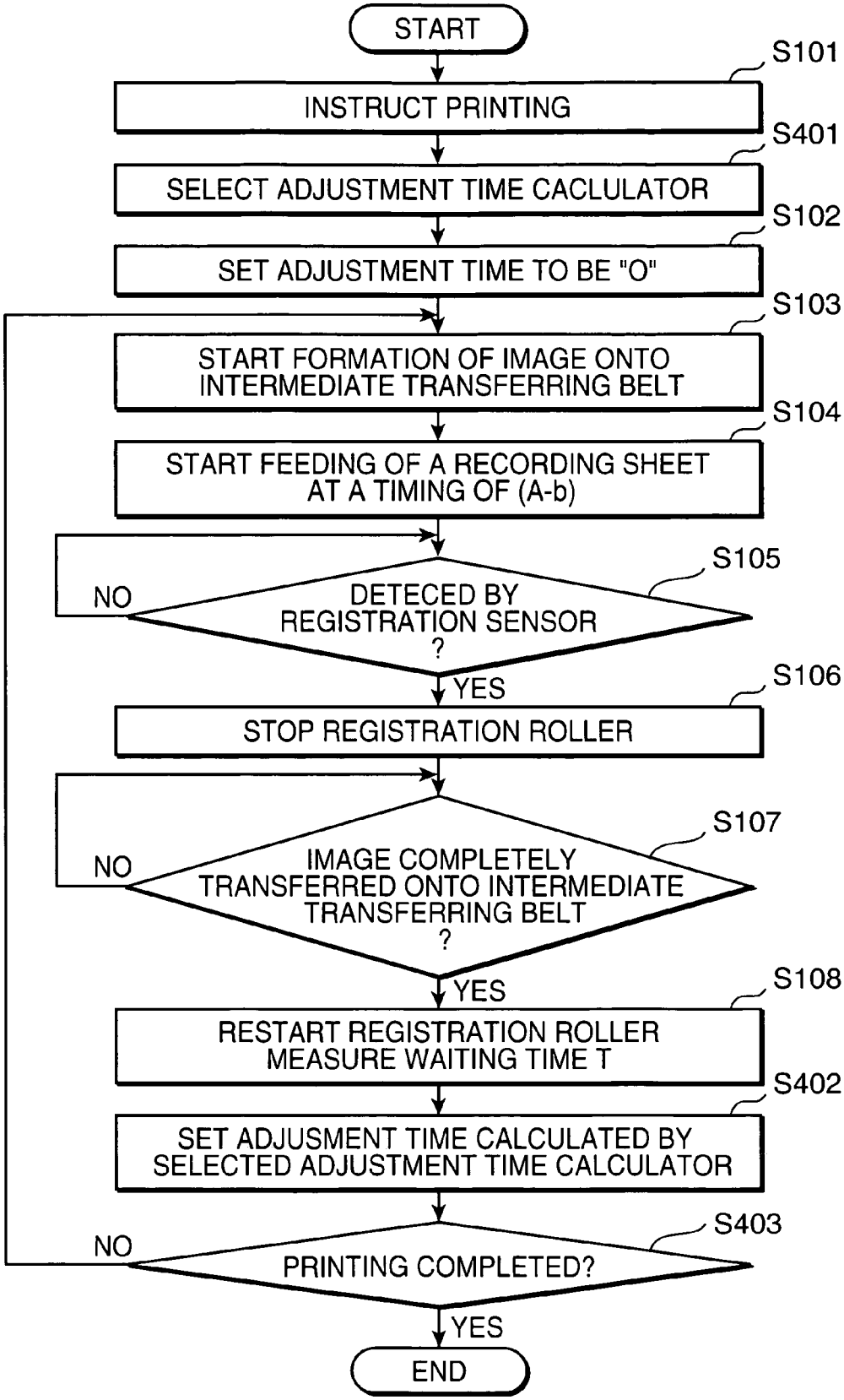
FIG. 8 is a flow chart showing a procedure of adjusting a sheet feed timing in the printer according to the still another embodiment of the invention.

FIG. 7 is a functional block diagram showing a schematic construction of a network printer system including a printer according to still another embodiment of the invention. FIG. 8 is a flow chart showing a procedure of adjusting the sheet feed timing in the printer shown in FIG. 7. In this embodiment, as compared to the embodiments shown in FIGS. 2 and 7, there are provided a plurality of adjustment time calculators 152*a* to 152*c*. In the procedure (hereinafter, referred to as a fourth procedure) shown in FIG. 8, Step S401 is added before Step S102, and the operations in Steps S109 and S110 in the first procedure are replaced by those in Steps S402 and S403 in the four procedure. The operations in the other steps in this procedure are identical to those in the other steps in the first procedure, and description of them is thus omitted.

In Step S401 in the fourth procedure, a user operates an operating portion 110 or a PC 112 to desirably select one among a plurality of adjustment time calculators 152*a* to 152*c*. That is to say, in this embodiment, the operating portion 110 or the PC 112 functions as a selector. The plurality of adjustment time calculators 152*a* to 152*c* are distinguished according to calculation procedures for calculating an adjustment time, for example, a calculation based on a currently stored deviation that is executed by the adjustment time calculator 152*a*, a calculation based on an average of a plurality of previous deviations before the instant time that is executed by the adjustment time calculator 152*b*. It should be noted that the plurality of adjustment time calculators 152*a* to 152*c* are singly represented in FIG. 7 for simplification. Further, the number of adjustment time calculators is not limited to the three, but may be increased or decreased according to needs.

An adjustment time is calculated by an adjustment time calculator selected by a user in Step S401. The calculated adjustment time is set in an adjustment time storing portion 151 (Step S402). As described above, this embodiment enables a user to select which result calculated by different calculation manners as an adjustment time. Accordingly, an optimum adjustment time can be set according to actual circumstances of the printer 1, and delay in sheet feeding can be suppressed efficiently.

The present invention is not limited to the foregoing embodiments, but the following modification may be made.

(A) In the foregoing embodiments, the suppression of sheet feeding delay is described as an example. Specifically, if a delay is detected to occur in the sheet feeding, the driving of the sheet feeding mechanism is started in a specified advanced time corresponding to the delay to assure the accurate transfer of an image formed on the intermediate transferring belt 9 onto a predetermined position of a recording sheet. However, the present invention is not limited to this. The present invention may be applied to suppress occurrence of a jamming due to an undesirably early sheet feeding. In such a case, the driving of the sheet feeding mechanism may be started in a specified retarded time corresponding to the earliness to assure the accurate transfer of an image formed on the intermediate transferring belt 9 onto a predetermined position of a recording sheet.

(B) In the foregoing embodiments, the description is focused to the operation of the sheet feeding mechanism including the sheet feeding rollers 22. Specifically, if a delay (or an earliness) is detected to occur in the sheet feeding, the driving of the sheet feeding mechanism is started in a specified advanced (or retarded) time corresponding to the delay (or earliness) to assure the accurate transfer of an image formed on the intermediate transferring belt 9 onto a predetermined position of a recording sheet. However, the present invention is not limited to this. For example, it may be appreciated that the controller 100 controls the pickup roller driving motor 115 or the sheet feeding roller driving motor 117 so as to feed the recording sheet at a higher speed or a lower speed. Specifically, if a delay is detected to occur in the sheet feeding, the pickup roller 14 or the sheet feeding rollers 22 are rotated in a higher speed to thereby eliminate the delay. On the other hand, if a undesirable earliness is detected to occur in the sheet feeding, the pickup roller 14 or the sheet feeding rollers 22 are rotated in a lower speed to thereby eliminate the earliness. Consequently, the waiting time becomes closer to the predetermined reference time, and an image is transferred assuredly.

(C) In the foregoing embodiments, an adjustment time is calculated each time a recording sheet passes the detecting position of the registration sensor 21, and adjustment based on the calculated deviation is performed for a next recording sheet. However, the present invention is not limited to this. Adjustment may be performed every a predetermined number of sheets because the deviation due to a wearing of rollers and such is constant for a considerable time. In this case, an adjustment time which has been obtained based on a calculated deviation for a particular recording sheet is maintained to perform the same control for a predetermined number of recording sheets. In this way, the delay or earliness in sheet feeding can be suppressed effectively at a reduced load to the controller.

(D) Further, a plurality of personal computers may be connected with the single printer 1 by the way of a network system such as LAN (Local Area Network). In this case, the printer 1 of the network printer system executes the sheet feeding control described with reference to FIGS. 1 through 8.

As described above, an image forming apparatus comprises: a sheet cassette for storing a number of recording sheets; a sheet feeding mechanism for picking up and conveying a recording sheet from the sheet cassette; an image bearing member rotated at a constant speed; an image forming unit for forming an image on the image bearing member; a registration roller for receiving a recording sheet conveyed by the sheet feeding mechanism, and holding the recording sheet temporarily, and restarting the conveyance of the recording sheet at a timing of transferring the image formed on the image bearing member by the image forming unit to a predetermined position of the recording sheet; a time counter for measuring a waiting time from the reception of the recording sheet by the registration roller to the start of the conveyance of the recording sheet by the registration roller; a calculator for calculating an adjustment time based on a deviation of a waiting time measured by the time counter against a predetermined reference time; and a controller for controlling the driving of the sheet feeding mechanism based on the calculated adjustment time so that the waiting time of a next recording sheet becomes closer to the predetermined reference time.

With this construction, a predetermined image is formed on the image bearing member by the image forming unit. A recording sheet is conveyed by the sheet feeding mechanism. The controller controls the conveyance of the recording sheet so that the image formed on the image bearing member is transferred to a predetermined position of the recording sheet. This control is realized by adjusting the driving of the sheet feeding mechanism and the registration roller. The recording sheet conveyed by the sheet feeding mechanism is temporarily held at the registration roller, and conveyed out from the registration roller at a predetermined timing. The time (waiting time) for holding the recording sheet should be ideally constant.

With that, the time counter measures a waiting time of a recording sheet and an adjustment time is calculated based on a deviation of a waiting time against the reference time which is set in advance at the time of initial setting. The controller controls the sheet feeding mechanism at the time of transferring an image to the next recording sheet so that the deviation calculated with respect to the recording sheet becomes close to "0" (zero). In other words, in the case where a delay in sheet feeding occurs due to a slippage between the recording sheet and the rollers for conveying the recording sheet, the controller controls the sheet feeding mechanism so as to start the conveyance of the recording sheet the deviated time earlier. On the contrary, in the case where an earliness in sheet feeding occurs, the controller controls the sheet feeding mechanism so as to start the conveyance of the recording sheet the deviated time later. Consequently, the delay or earliness in sheet feeding can be suppressed efficiently.

Preferably, the controller may control the driving of the sheet feeding mechanism to start the pickup and conveyance of a recording sheet the adjustment time earlier than the start timing of the previous feeding, if the measured waiting time is smaller than the reference time.

With this construction, the controller makes the sheet feeding mechanism feed a recording sheet the adjustment time (delayed time in sheet feeding) earlier than the start timing of the previous feeding. The delay in sheet feeding due to a slippage between the recording sheet and the rollers for conveying the recording sheet can be suppressed efficiently with a simple construction.

Preferably, the controller may control the driving of the sheet feeding mechanism to rotate so faster as to allow a picked recording sheet to reach a registration roller the adjustment time earlier than the previous feeding, if the waiting time is smaller than the reference time.

With this construction, the controller controls the sheet feeding mechanism so faster as to compensate for the deviated time (delayed time in sheet feeding) occurred in the previous sheet feeding by increasing the conveyance speed of the sheet feeding mechanism. The sheet feeding mechanism conveys the recording sheet at a speed faster than the usual speed to suppress the delay in sheet feeding more efficiently.

Preferably, the calculator may compare a current deviation of a current waiting time measured by the time counter against the reference time with an average of previous deviations of previous waiting times measured in multiple times by the time counter against the reference time, and determines as the adjustment time an average of the previous deviations and the current deviation if a difference between the previous deviations and the current deviation is within a predetermined range, and determines as the adjustment time the average of the previous deviations if a difference between the previous deviations and the current deviation is beyond the predetermined range.

With this construction, the calculator calculates an average of a number of previous deviations. As an average, an arithmetic average or a geometric average may be selectively adopted. An average of the previous deviations and the current deviation is determined as the adjustment time, if a difference between the previous deviations and the current deviation is within a predetermined range. An average of the previous deviations is determined as the adjustment time, if a difference between the previous deviations and the current deviation is beyond the predetermined range. Accordingly, an exceptional adjustment time can be eliminated efficiently, and the delay in sheet feeding can be suppressed more assuredly.

The image forming apparatus may be preferably further provided with a memory for storing the calculated adjustment time, wherein the controller controls the driving of the sheet feeding mechanism based on the adjustment time stored in the memory for the first pickup and conveyance of a recording sheet after the image forming apparatus is initially turned on.

With this construction, at the time of transferring an image to a first recording sheet after the image forming apparatus is initially turned on, the controller reads the current adjustment time from the memory. Since the memory stores the last adjustment time, the adjustment time read by the controller is the one calculated immediately before the image forming apparatus is turned off. The delay in sheet feeding due to a slippage between the recording sheet and the rollers for conveying the recording sheet is usually to be small. Therefore, the controller can control the sheet feeding mechanism so as to compensate for the read deviated time, and can thereby suppress a delay in sheet feeding from the image forming operation for a first recording sheet.

The time counter may be preferably constructed by a free-run time counter which performs counting in interruption pulses used in the conveyance control of recording sheet.

With this construction, a free-run timer which is provided in a usual image forming apparatus is used as the time counter, and a deviated time may be measured without any special member for this control. Consequently, the production costs can be prevented from increasing.

The calculator may preferably include a plurality of selective adjustment time calculation procedures. The image forming apparatus may further comprise a selector for selecting desired one among the plurality of selective adjustment time calculation procedures.

With this construction, an optimum calculation procedure for calculating an adjustment time can be selected by the selector among the plurality of selective adjustment time calculation procedures.

Accordingly, a user can select which calculation procedure is used for calculating an adjustment time. Accordingly, a delay in sheet feeding can be suppressed efficiently by selecting an optimum calculation procedure according to actual circumstances of the image forming apparatus.

Further, the image forming apparatus may be preferably connected with a network system including a terminal device connected with the image forming apparatus. The terminal device has a selector for selecting a desired one among the plurality of selective adjustment time calculation procedures.

With this construction, an optimum calculation procedure for calculating an adjustment time is selected by the terminal device by the network system. Accordingly, a user can select an optimum calculation procedure more easily.

This application is based on patent application No. 2005-159043 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a sheet cassette for storing a number of recording sheets;

a sheet feeding mechanism for picking up and conveying a recording sheet from the sheet cassette;

an image bearing member rotated at a constant speed;

an image forming unit for forming an image on the image bearing member;

a registration roller for receiving a recording sheet conveyed by the sheet feeding mechanism, and holding the recording sheet temporarily, and restarting the conveyance of the recording sheet at a timing of transferring the image formed on the image bearing member by the image forming unit to a predetermined position of the recording sheet;

a time counter for measuring a waiting time from the reception of the recording sheet by the registration roller to the start of the conveyance of the recording sheet by the registration roller;

a calculator for calculating an adjustment time based on a deviation of a waiting time measured by the time counter against a predetermined reference time; and a controller for controlling the driving of the sheet feeding mechanism based on the calculated adjustment time so that the waiting time of a next recording sheet becomes closer to the predetermined reference time and wherein the controller controls the driving of the sheet feeding mechanism to start the pickup and conveyance of a recording sheet so that the adjustment time is earlier than the start timing of the previous feeding, if the measured waiting time is shorter than the reference time.

2. An image forming apparatus according to claim 1, further comprising a memory for storing a currently calculated adjustment time, wherein the controller controls the driving of the sheet feeding mechanism based on the adjustment time stored in the memory for the first pickup and conveyance of a recording sheet after the image forming apparatus is initially turned on.

3. An image forming apparatus according to claim 1, wherein the time counter is a free-run time counter which performs counting in interruption pulses used in the conveyance control of recording sheet.

4. An image forming apparatus comprising:

a sheet cassette for storing a number of recording sheets;

a sheet feeding mechanism for picking up and conveying a recording sheet from the sheet cassette;

an image bearing member rotated at a constant speed;

an image forming unit for forming an image on the image bearing member;

a registration roller for receiving a recording sheet conveyed by the sheet feeding mechanism, and holding the recording sheet temporarily, and restarting the conveyance of the recording sheet at a timing of transferring the image formed on the image bearing member by the image forming unit to a predetermined position of the recording sheet;

a time counter for measuring a waiting time from the reception of the recording sheet by the registration roller to the start of the conveyance of the recording sheet by the registration roller;

a calculator for calculating an adjustment time based on a deviation of a waiting time measured by the time counter against a predetermined reference time; and a controller for controlling the driving of the sheet feeding mechanism based on the calculated adjustment time so that the waiting time of a next recording sheet becomes closer to the predetermined reference time and, wherein the controller controls the driving of the sheet feeding mechanism to rotate so faster as to allow a picked recording sheet to reach the registration roller the adjustment time earlier than the previous feeding, if the waiting time is shorter than the reference time.

5. An image forming apparatus comprising:

a sheet cassette for storing a number of recording sheets;

a sheet feeding mechanism for picking up and conveying a recording sheet from the sheet cassette;

an image bearing member rotated at a constant speed;

an image forming unit for forming an image on the image bearing member;

a registration roller for receiving a recording sheet conveyed by the sheet feeding mechanism, and holding the recording sheet temporarily, and restarting the conveyance of the recording sheet at a timing of transferring the image formed on the image bearing member by the image forming unit to a predetermined position of the recording sheet;

a time counter for measuring a waiting time from the reception of the recording sheet by the registration roller to the start of the conveyance of the recording sheet by the registration roller;

a calculator for calculating an adjustment time based on a deviation of a waiting time measured by the time counter against a predetermined reference time and, wherein the calculator compares a current deviation of a current waiting time measured by the time counter against the reference time with an average of previous deviations of previous waiting times measured in multiple times by the time counter against the reference time, and determines as the adjustment time an average of the previous deviations and the current deviation if a difference between the previous deviations and the current deviation is within a predetermined range, and determines as the adjustment time the average of the previous deviations if a difference between the previous deviations and the current deviation is beyond the predetermined range; and a controller for controlling the driving of the sheet feeding mechanism based on the calculated adjustment time so that the waiting time of a next recording sheet becomes closer to the predetermined reference time.

6. An image forming apparatus comprising:

a sheet cassette for storing a number of recording sheets;

a sheet feeding mechanism for picking up and conveying a recording sheet from the sheet cassette;

an image bearing member rotated at a constant speed;

an image forming unit for forming an image on the image bearing member;

a registration roller for receiving a recording sheet conveyed by the sheet feeding mechanism, and holding the recording sheet temporarily, and restarting the conveyance of the recording sheet at a timing of transferring the image formed on the image bearing member by the image forming unit to a predetermined position of the recording sheet;

a time counter for measuring a waiting time from the reception of the recording sheet by the registration roller to the start of the conveyance of the recording sheet by the registration roller;

a calculator for calculating an adjustment time based on a deviation of a waiting time measured by the time counter against a predetermined reference time and, wherein the calculator includes a plurality of selective adjustment time calculation procedures to calculate an adjustment time, further comprising a selector for selecting a desired one among the plurality of selective adjustment time calculation procedures; and a controller for controlling the driving of the sheet feeding mechanism based on the calculated adjustment time so that the waiting time of a next recording sheet becomes closer to the predetermined reference time.

7. A network system comprising:

an image forming apparatus including:

a sheet cassette for storing a number of recording sheets;

a sheet feeding mechanism for picking up and conveying a recording sheet from the sheet cassette;

an image bearing member rotated at a constant speed;

an image forming unit for forming an image of a predetermined color on the image bearing member;

a registration roller for receiving a recording sheet conveyed by the sheet feeding mechanism, and holding the recording sheet temporarily, and starting the conveyance of the recording sheet at a timing of transferring the image formed on the image bearing member by the image forming unit to a predetermined position of the recording sheet;

a time counter for measuring a waiting time from the reception of the recording sheet by the registration roller to the start of the conveyance of the recording sheet by the registration roller;

a calculator for calculating an adjustment time based on a deviation of a waiting time measured by the time counter against a reference time, the calculator having a plurality of selective adjustment time calculation procedures; and a controller for controlling the driving of the sheet feeding mechanism based on the calculated adjustment time so that the waiting time of a next recording sheet becomes closer to the predetermined reference time;

a terminal device connected with the image forming apparatus, the terminal device including a selector for selecting a desired one among a plurality of selective adjustment time calculation procedures to calculate an adjustment time.

* * * * *